US007908830B2

(12) United States Patent
Cousins et al.

(10) Patent No.: US 7,908,830 B2
(45) Date of Patent: Mar. 22, 2011

(54) CARRIAGE FOR A STRETCH WRAPPING MACHINE

(75) Inventors: Neil G. Cousins, Tottenham (CA); Srbislav Z. Davidovic, Oakville (CA)

(73) Assignee: Cousins Packaging Inc., Etobicoke, Ontario (CA)

( * ) Notice: Subject to any disclaimer, the term of this patent is extended or adjusted under 35 U.S.C. 154(b) by 208 days.

(21) Appl. No.: 12/250,125

(22) Filed: Oct. 13, 2008

(65) Prior Publication Data

US 2009/0094942 A1 Apr. 16, 2009

Related U.S. Application Data

(60) Provisional application No. 60/979,623, filed on Oct. 12, 2007.

(51) Int. Cl.
*B65B 53/00* (2006.01)

(52) U.S. Cl. ..... 53/556; 53/436; 53/441; 53/203

(58) Field of Classification Search ..... 53/436, 53/441, 461, 465, 556, 203; 241/419.6, 419.8, 241/419.9; 242/419.6, 419.8, 419.9
See application file for complete search history.

(56) References Cited

U.S. PATENT DOCUMENTS

| | | | | | |
|---|---|---|---|---|---|
| 3,985,277 | A * | 10/1976 | Wright | 226/177 |
| 4,450,668 | A | 5/1984 | Grossi | |
| 4,590,746 | A * | 5/1986 | Humphrey | 53/556 |
| 4,862,678 | A * | 9/1989 | Humphrey | 53/556 |
| 5,161,349 | A | 11/1992 | Lancaster, III et al. | |
| 5,195,301 | A | 3/1993 | Martin-Cocher et al. | |
| 5,414,979 | A * | 5/1995 | Moore et al. | 53/556 |
| 5,522,203 | A | 6/1996 | Lancaster, III et al. | |
| 5,765,344 | A * | 6/1998 | Mandeville et al. | 53/441 |
| 5,875,616 | A * | 3/1999 | Paavola et al. | 53/556 |
| 6,082,081 | A * | 7/2000 | Mucha | 53/556 |
| 6,185,914 | B1 * | 2/2001 | Mackie | 53/556 |
| 6,311,459 | B1 * | 11/2001 | Rossi | 53/389.2 |
| 6,713,010 | B1 * | 3/2004 | Doran et al. | 264/289.6 |
| 7,107,743 | B2 * | 9/2006 | Suolahti | 53/556 |
| 7,533,515 | B1 * | 5/2009 | Koskela | 53/556 |
| 7,540,128 | B2 * | 6/2009 | Lancaster et al. | 53/556 |
| 2002/0174628 | A1 | 11/2002 | Lancaster, III et al. | |
| 2004/0163364 | A1 * | 8/2004 | Cousins et al. | 53/556 |
| 2005/0044812 | A1 | 3/2005 | Lancaster, III et al. | |
| 2005/0050861 | A1 * | 3/2005 | Suolahti | 53/556 |
| 2006/0254225 | A1 | 11/2006 | Lancaster, III et al. | |

* cited by examiner

*Primary Examiner* — Hemant M Desai
(74) *Attorney, Agent, or Firm* — Price, Heneveld, Cooper, DeWitt & Litton, LLP

(57) ABSTRACT

A stretch wrap assembly comprising a base, a turntable mounted on the base, a column on the base and a carriage movable upon the column. The carriage includes a first nip roller, a first pre-stretch roller, an idler roller, a second pre-stretch roller and a second nip roller. The carriage is configured to have stretch wrap threaded through the carriage from a roll of stretch wrap, around a portion of a circumferences of the first nip roller, the first pre-stretch roller, the idler roller, the second pre-stretch roller, and the second nip roller and to the package. The first nip roller and the second nip roller can be on a chassis to be able to move rotationally and laterally relative to the first pre-stretch roller and the second pre-stretch roller.

36 Claims, 8 Drawing Sheets

CARRIAGE FOR A STRETCH WRAPPING MACHINE

CROSS REFERENCE TO RELATED APPLICATION

This application claims priority to U.S. Provisional Patent Application No. 60/979,623 filed on Oct. 12, 2007 entitled CARRIAGE FOR A STRETCH WRAPPING MACHINE.

FIELD OF THE INVENTION

The present invention concerns stretch wrapping machines, and more particularly relates to a carriage for a stretch wrapping machine.

SUMMARY OF THE PRESENT INVENTION

Figure 1:
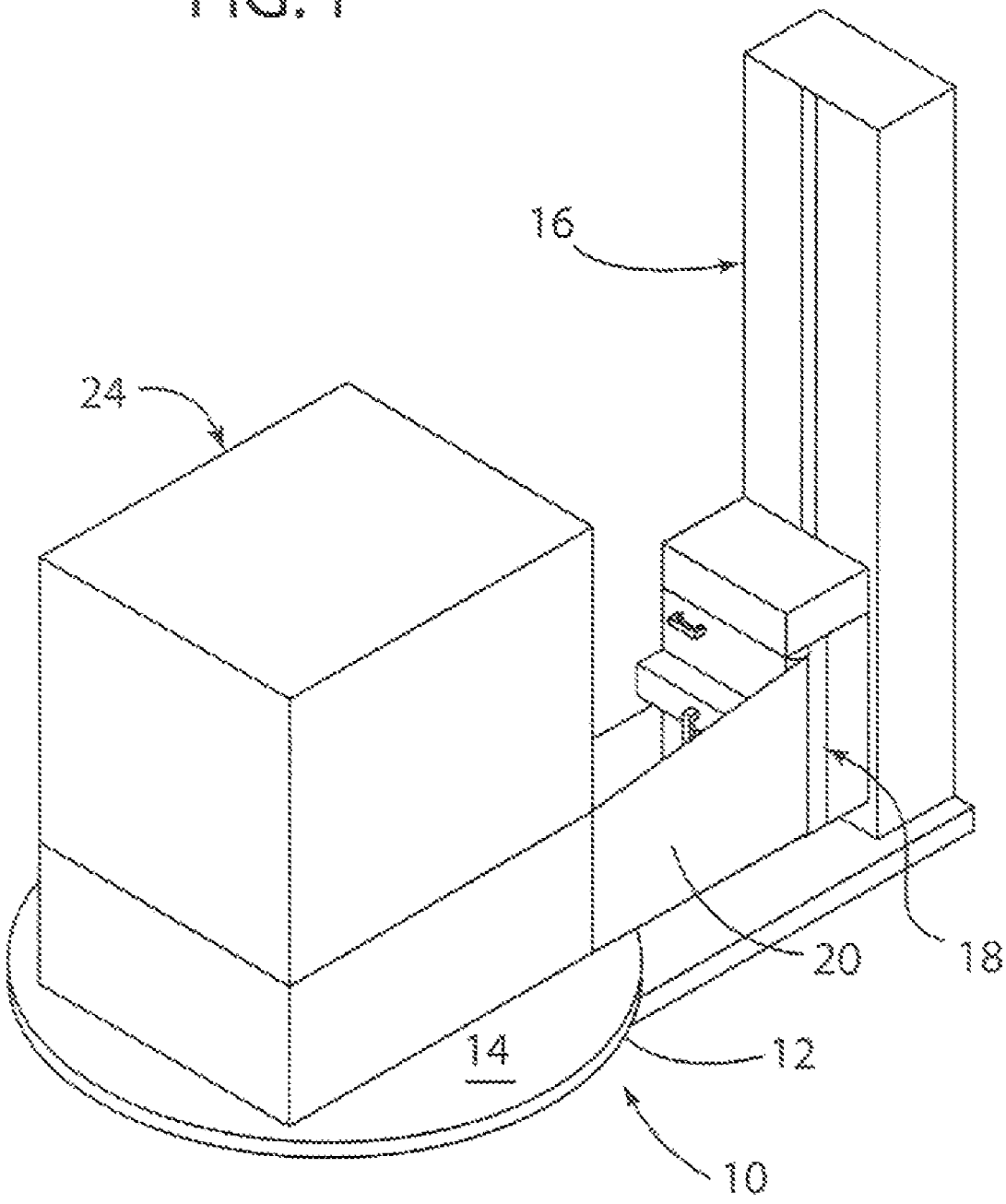
FIG. 1 is a perspective view of a wrap machine of the present invention.

An aspect of the present invention is to provide a stretch wrap assembly comprising a base, a turntable mounted on the base, a column extending upwardly from the base, and a carriage vertically movable upon the column, with the carriage being configured to have stretch wrap thereon for wrapping a product on the turntable. The carriage includes a first nip roller, a first pre-stretch roller, an idler roller, a second pre-stretch roller and a second nip roller. The carriage is configured to have stretch wrap threaded through the carriage from a roll of stretch wrap, around a portion of a circumference of the first nip roller, around a portion of a circumference of the first pre-stretch roller, around a portion of a circumference of the idler roller, around a portion of a circumference of the second pre-stretch roller, around a portion of a circumference of the second nip roller and to the package. The idler roller rotates freely and is positioned to maintain the stretch wrap against the first pre-stretch roller and the second pre-stretch roller. The first nip roller is configured to maintain the stretch wrap against the first pre-stretch roller as the stretch wrap is stretched by the first pre-stretch roller. The second nip roller is configured to maintain the stretch wrap against the second pre-stretch roller as the stretch wrap is stretched by the second pre-stretch roller. The first nip roller and the second nip roller can move rotationally and laterally relative to the first pre-stretch roller and the second pre-stretch roller, respectively. The idler roller is spaced from the first pre-stretch roller such that the idler roller and the first pre-stretch roller do not touch. The idler roller is spaced from the second pre-stretch roller such that the idler roller and the second pre-stretch roller do not touch. A center of rotation of the idler roller is located on a first side of a line drawn between a center of rotation of the first pre-stretch roller and a center of rotation of the second pre-stretch roller. A center of rotation of first nip roller is located on a second side of the line drawn between the center of rotation of the first pre-stretch roller and the center of rotation of the second pre-stretch roller. A center of rotation of the second nip roller is also located on the second side of the line drawn between the center of rotation of the first pre-stretch roller and the center of rotation of the second pre-stretch roller.

Another aspect of the present invention is to provide a carriage for a stretch wrap machine comprising a housing including a first nip roller, a first pre-stretch roller, an idler roller, a second pre-stretch roller and a second nip roller. The carriage is configured to have stretch wrap threaded through the carriage from a roll of stretch wrap, around a portion of a circumference of the first nip roller, around a portion of a circumference of the first pre-stretch roller, around a portion of a circumference of the idler roller, around a portion of a circumference of the second pre-stretch roller, around a portion of a circumference of the second nip roller and to the package. The idler roller rotates freely and is positioned to maintain the stretch wrap against the first pre-stretch roller and the second pre-stretch roller. The first nip roller is configured to maintain the stretch wrap against the first pre-stretch roller as the stretch wrap is stretched by the first pre-stretch roller. The second nip roller is configured to maintain the stretch wrap against the second pre-stretch roller as the stretch wrap is stretched by the second pre-stretch roller. The first nip roller and the second nip roller can move rotationally and laterally relative to the first pre-stretch roller and the second pre-stretch roller, respectively. The idler roller is spaced from the first pre-stretch roller such that the idler roller and the first pre-stretch roller do not touch. The idler roller is spaced from the second pre-stretch roller such that the idler roller and the second pre-stretch roller do not touch. A center of rotation of the idler roller is located on a first side of a line drawn between a center of rotation of the first pre-stretch roller and a center of rotation of the second pre-stretch roller. A center of rotation of the first nip roller is located on a second side of the line drawn between the center of rotation of the first pre-stretch roller and the center of rotation of the second pre-stretch roller. A center of rotation of the second nip roller is also located on the second side of the line drawn between the center of rotation of the first pre-stretch roller and the center of rotation of the second pre-stretch roller.

Yet another aspect of the present invention is to provide a carriage for a stretch wrap machine comprising a housing having a base portion and a chassis movable relative to the base portion between an open position and a closed engaged position. The base portion includes a first pre-stretch roller and a second pre-stretch roller thereon. The chassis has a first nip roller, an idler roller and a second nip roller thereon. The housing, when in the closed engaged position, is configured to have stretch wrap threaded through the carriage from a roll of stretch wrap, around a portion of a circumference of the first nip roller, around a portion of a circumference of the first pre-stretch roller, around a portion of a circumference of the idler roller, around a portion of a circumference of the second pre-stretch roller, around a portion of a circumference of the second nip roller and to the package. When the housing is in the closed engaged position, the idler roller rotates freely and is positioned to maintain the stretch wrap against the first pre-stretch roller and the second pre-stretch roller, the first nip roller is configured to maintain the stretch wrap against the first pre-stretch roller as the stretch wrap is stretched by the first pre-stretch roller, and the second nip roller is configured to maintain the stretch wrap against the second pre-stretch roller as the stretch wrap is stretched by the second pre-stretch roller. The first nip roller and the second nip roller can move laterally relative to the first pre-stretch roller and the second pre-stretch roller, respectively, by moving the housing between the open position and the closed engaged position. The idler roller is spaced from the first pre-stretch roller such that the idler roller and the first pre-stretch roller do not touch when the housing is in the engaged position. The idler roller is spaced from the second pre-stretch roller such that the idler roller and the second pre-stretch roller do not touch when the housing is in the engaged position.

A further aspect of the present invention is to provide a carriage for a stretch wrap machine comprising a housing having a base portion and a chassis movable relative to the base portion between an open position and a closed engaged position. The base portion includes a first pre-stretch roller and a second pre-stretch roller thereon. The chassis has a first nip roller, an idler roller and a second nip roller thereon. The housing, when in the closed engaged position, is configured to have stretch wrap threaded through the carriage from a roll of stretch wrap, around a portion of a circumference of the first nip roller, around a portion of a circumference of the first pre-stretch roller, around a portion of a circumference of the idler roller, around a portion of a circumference of the second pre-stretch roller, around a portion of a circumference of the second nip roller and to the package. When the housing is in the closed engaged position, the idler roller rotates freely and is positioned to maintain the stretch wrap against the first pre-stretch roller and the second pre-stretch roller, the first nip roller is configured to maintain the stretch wrap against the first pre-stretch roller as the stretch wrap is stretched by the first pre-stretch roller, and the second nip roller is configured to maintain the stretch wrap against the second pre-stretch roller as the stretch wrap is stretched by the second pre-stretch roller. In the open position, the idler roller is not directly located between the first pre-stretch roller and the second pre-stretch roller. In the closed engaged position, the idler roller is directly located between the first pre-stretch roller and the second pre-stretch roller. The idler roller moves along a first plane as the housing moves from the open position to the closed engaged position. The first nip roller and the second nip roller firstly move along a second plane and a third plane, respectively, as the housing moves from the open position to the closed engaged position and then secondly moves along a first arc and a second arc as the housing moves from the open position to the closed engaged position. The first plane, the second plane and the third plane are parallel.

These and other aspects, objects, and features of the present invention will be understood and appreciated by those skilled in the art upon studying the following specification, claims, and appended drawings.

DETAILED DESCRIPTION OF THE PREFERRED EMBODIMENT

For purposes of description herein, the terms "upper," "lower," "right," "left," "rear," "front," "vertical," "horizontal," and derivatives thereof shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts. Hence, specific dimensions and other physical characteristics relating to the embodiments disclosed herein are not to be considered as limiting.

The reference number 10 (FIG. 1) generally designates a wrap machine of the present invention. The wrap machine 10 includes a base 12 having a turntable 14 mounted thereon. The wrap machine 10 further includes a column 16 having a vertically movable carriage 18 (shown schematically) located thereon. Stretch wrap 20 moves with the carriage 18. The stretch wrap 20 wraps a package 24 mounted on the turntable 14 and rotating therewith. Although not shown, the wrap machine 10 may also include a gripping and cutting device for gripping the stretch wrap 20 and cutting the stretch wrap 20 during certain portions of the process of wrapping the stretch wrap 20 about the package 24. Such gripping and cutting devices are well known to those skilled in the art.

Figure 2:
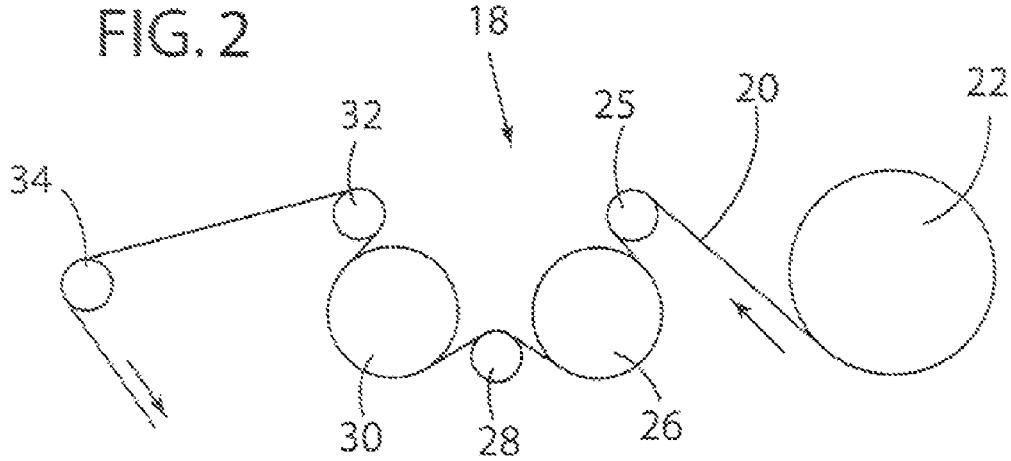
FIG. 2 is a schematic view of a carriage of the wrap machine of the present invention in a loaded (threaded) and ready to wrap position.

In the illustrated example, the carriage 18 (FIG. 2) is used to prestretch the stretch wrap 20. FIG. 2 illustrates schematically prestretching components of the carriage 18 of the present invention. As illustrated in FIG. 2, the carriage 18 includes a source of the stretch wrap 20 in the form of a roll 22 of stretch wrap 20, a first nip roller 25, a first pre-stretch roller 26, an idler roller 28, a second pre-stretch roller 30, a second nip roller 32 and a dancer roller 34. The stretch wrap 20 is threaded through the carriage 18 from the roll 22 of stretch wrap 20, around a portion of the circumference of the first nip roller 25, around a portion of the circumference of the first pre-stretch roller 26, around a portion of the circumference of the idler roller 28, around a portion of the circumference of the second pre-stretch roller 30, around a portion of the circumference of the second nip roller 32, around a portion of the circumference of the a dancer roller 34, and to the package 24. The first pre-stretch roller 26 and the second pre-stretch roller 30 are driven (rotated) at different speeds and/or have a different circumference in order to stretch the stretch wrap 20 as it passes by the first pre-stretch roller 26 and the second pre-stretch roller 30 (as is well known to those skilled in the art). The idler roller 28 rotates freely and is positioned to maintain the stretch wrap 20 against the first pre-stretch roller 26 and the second pre-stretch roller 30. The first nip roller 25 is configured to maintain the stretch wrap 20 against the first pre-stretch roller 26 as the stretch wrap 20 is stretched by the first pre-stretch roller 26. Likewise, the second nip roller 32 is configured to maintain the stretch wrap 20 against the second pre-stretch roller 30 as the stretch wrap 20 is stretched by the second pre-stretch roller 30.

Figure 3:
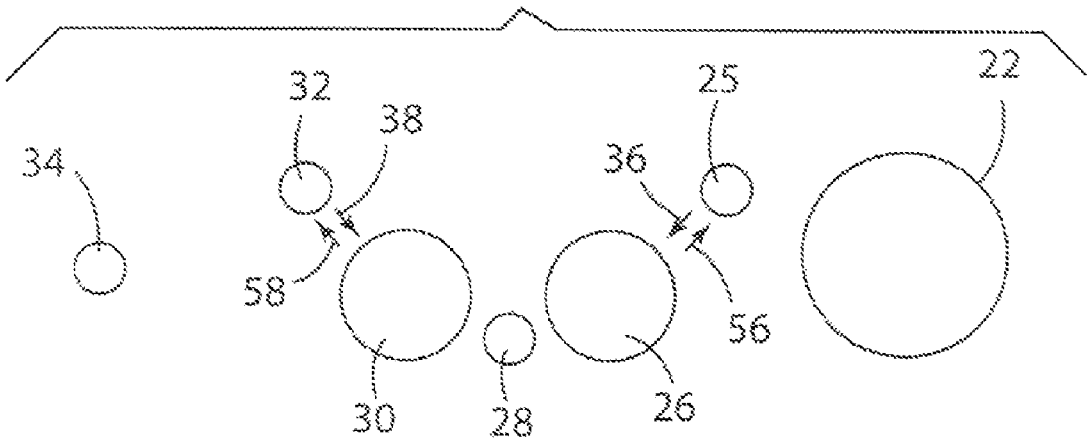
FIG. 3 is a schematic view of the carriage of the wrap machine of the present invention in a position between the loaded (threaded) and ready to wrap position and a loading position.

The illustrated carriage 18 allows the first nip roller 25, the second nip roller 32 and the idler roller 28 to be spaced from the first pre-stretch roller 26 and the second pre-stretch roller 30 to allow the stretch wrap 20 to be threaded through the carriage 18. As illustrated in FIG. 3, the first nip roller 25 is configured to be moved away from the first pre-stretch roller 26 along line 56 (which can be straight or angled). Likewise, the second nip roller 32 is configured to be moved away from the second pre-stretch roller 30 along line 58 (which can be straight or angled). As described below, the first nip roller 25, the second nip roller 32 and the idler roller 28 are located on a chassis to allow the first nip roller 25, the second nip roller 32 and the idler roller 28 to be moved relative to the first pre-stretch roller 26 and the second pre-stretch roller 30. However, it is contemplated that the first nip roller 25, the second nip roller 32 and the idler roller 28 could each be located on individual chassis (or two of these on a single chassis and one of these on a single chassis) to allow the first nip roller 25, the second nip roller 32 and the idler roller 28 to be moved relative to the first pre-stretch roller 26 and the second pre-stretch roller 30.

Figure 4:
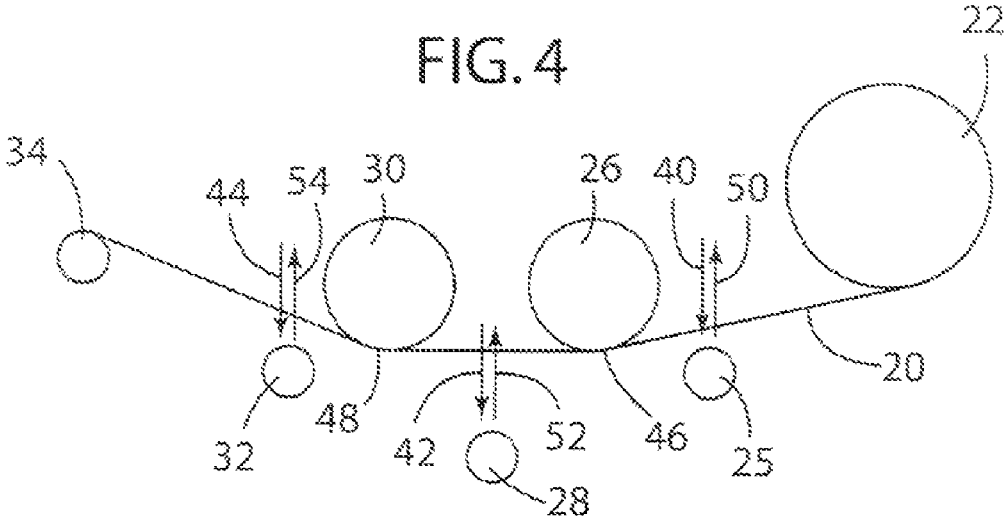
FIG. 4 is a schematic view of the carriage of the wrap machine of the present invention in the loading position.

FIG. 4 illustrates one manner of moving the first nip roller 25, the second nip roller 32 and the idler roller 28 relative to the first pre-stretch roller 26 and the second pre-stretch roller 30. As illustrated in FIG. 4, the first nip roller 25 can move along line 40, the second nip roller 32 can move along line 44 and the idler roller 28 can move along line 42. Thereafter, the stretch wrap 20 can easily be routed or threaded along a bottom 46 of the first pre-stretch roller 26 and a bottom 48 of the second pre-stretch roller 30 to the dancer roller 34 as illustrated in FIG. 4. Then, the first nip roller 25 can move along line 50 (opposite to line 40), the second nip roller 32 can move along line 54 (opposite to line 44) and the idler roller 28 can move along line 52 (opposite to line 42). Finally, as illustrated in FIG. 3, the first nip roller can move back to its base position along line 36 (opposite to line 56) and the second nip roller 32 can move back to its base position along line 38 (opposite to line 58), to finish in the position shown in FIG. 2.

Figure 6:
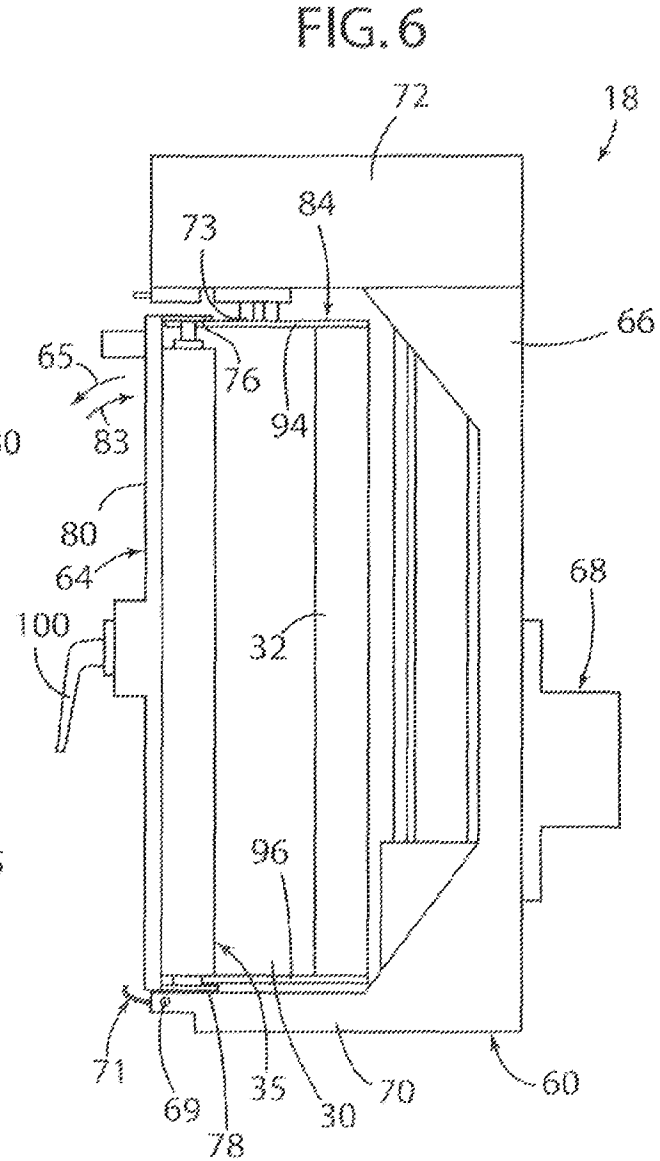
FIG. 6 is a side view of the carriage of the wrap machine of the present invention.
Figure 5:
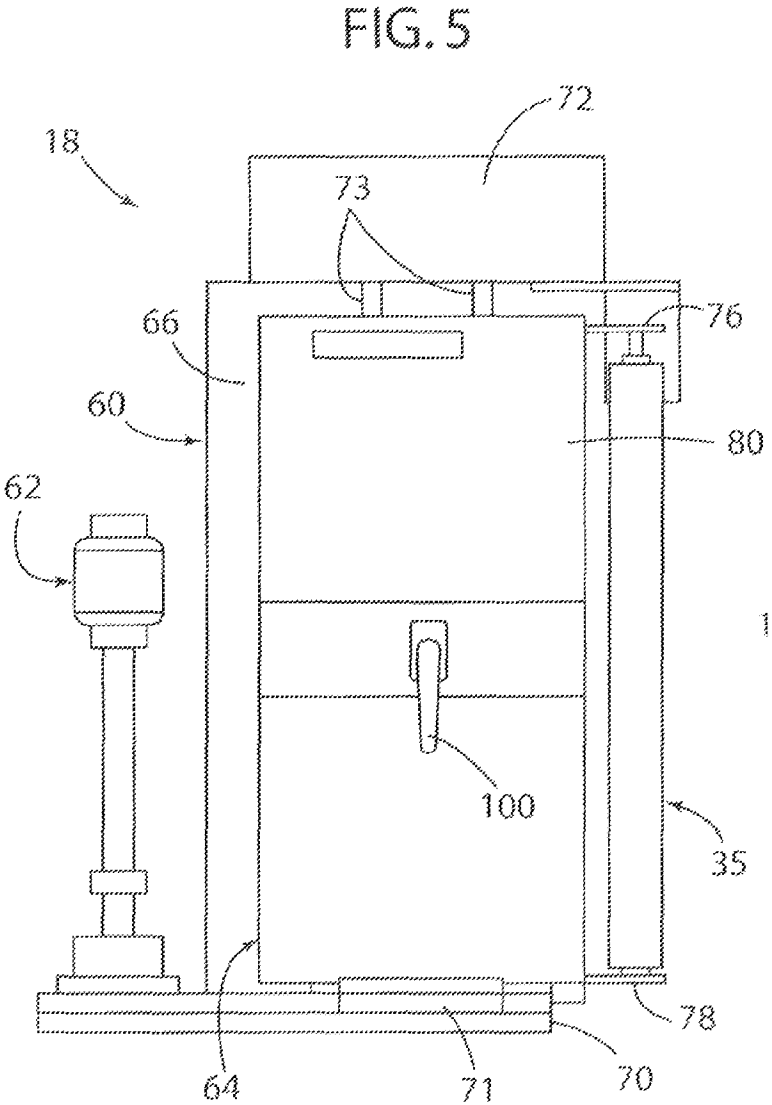
FIG. 5 is a front view of the carriage of the wrap machine of the present invention.
Figure 7:
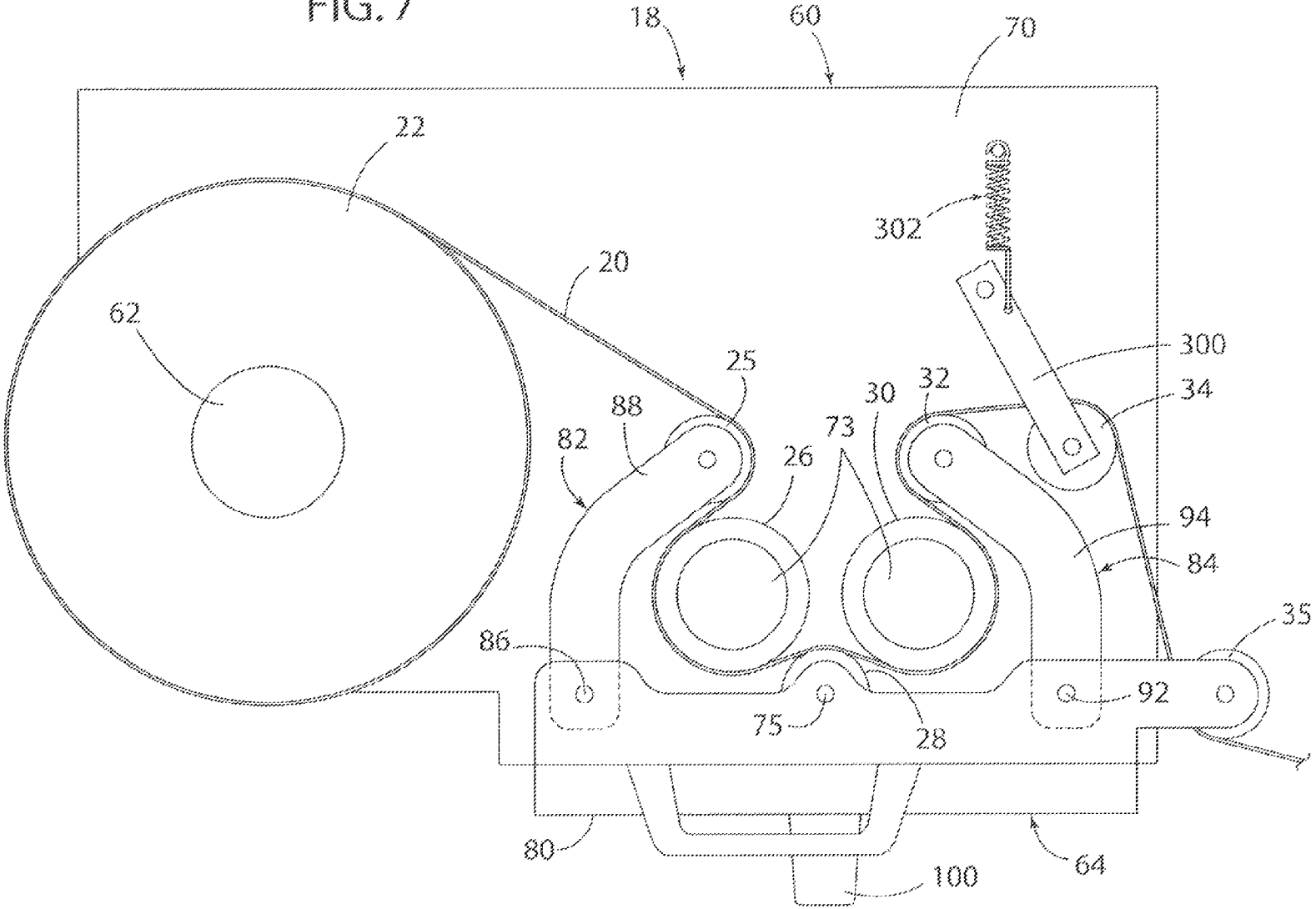
FIG. 7 is a top view of the carriage of the wrap machine of the present invention with a top housing member and rear housing member removed for clarity.

FIGS. 5 and 6 illustrate an embodiment of the carriage 18 of the present invention. The carriage 18 includes a base housing 60 configured to ride on the column 16 as is well known to those skilled in the art. In the illustrated example, the base housing 60 includes a rear wall 66 having a vertical travel attachment assembly 68 configured to be located on a support within the column 16 to allow the carriage 18 to move vertically on the column 16. The base housing 60 also includes a bottom housing member 70 and a top housing member 72 connected to the rear wall 66. FIG. 7 illustrates the carriage 18 without the top housing member 72 and the rear wall 66 for a better understanding of the embodiment of the present invention. As illustrated in FIGS. 5-7, the first pre-stretch roller 26 and the second pre-stretch roller 30 are each connected to an axle 73 extending between the top housing member 72 and the bottom housing member 70. The top housing member 72 and/or the bottom housing member 70 can include components for controlling the rotation of the first pre-stretch roller 26 and the second pre-stretch roller 30 to control the prestretching of the stretch wrap 20 as is well known to those skilled in the art. The bottom housing member 70 also includes a pivot pin (not shown) for pivotally connecting a chassis 64 to the base housing 60. The bottom housing member 70 can also include a pivot stop 71 for limiting pivotal movement of the chassis 64. The base housing 60 has a mandrel 62 for receiving the roll 22 of stretch wrap 20. The base housing 60 also includes the first pre-stretch roller 26, the second pre-stretch roller 30 and the dancer roller 34. The first nip roller 25, the second nip roller 32 and the idler roller 28 are connected to a chassis or door 64 (see FIG. 8) movable relative to the base housing 60 by extending a pivot pin (not shown) through openings 61 in pivot blocks 63 extending from a bottom of the chassis 64 to allow the chassis 64 to pivot along line 65 as illustrated in FIG. 6. In the illustrated example, the chassis 64 is pivotally connected to the base housing 60. However, it is contemplated that the chassis 64 could be slidably connected to the base housing 60 (e.g., using drawer slides).

As illustrated in FIGS. 5-8, the chassis 64 is pivotally connected to a front of the bottom housing member 70 of the base housing 60 to allow the chassis 64 to be rotated along line 65 (see FIG. 6) relative to the base housing 60. The chassis 64 comprises a U-shaped door 74 having a top portion 76, a bottom portion 78 and a front face portion 80 extending between the top portion 76 and the bottom portion 78. The idler roller 28 is located on an axle 75 extending between the top portion 76 and the bottom portion 78 of the U-shaped door 74. The U-shaped door 74 also includes a first nip roller assembly 82 having the first nip roller 25 and a second nip roller assembly 84 having the second nip roller 32 connected thereto.

Figure 8:
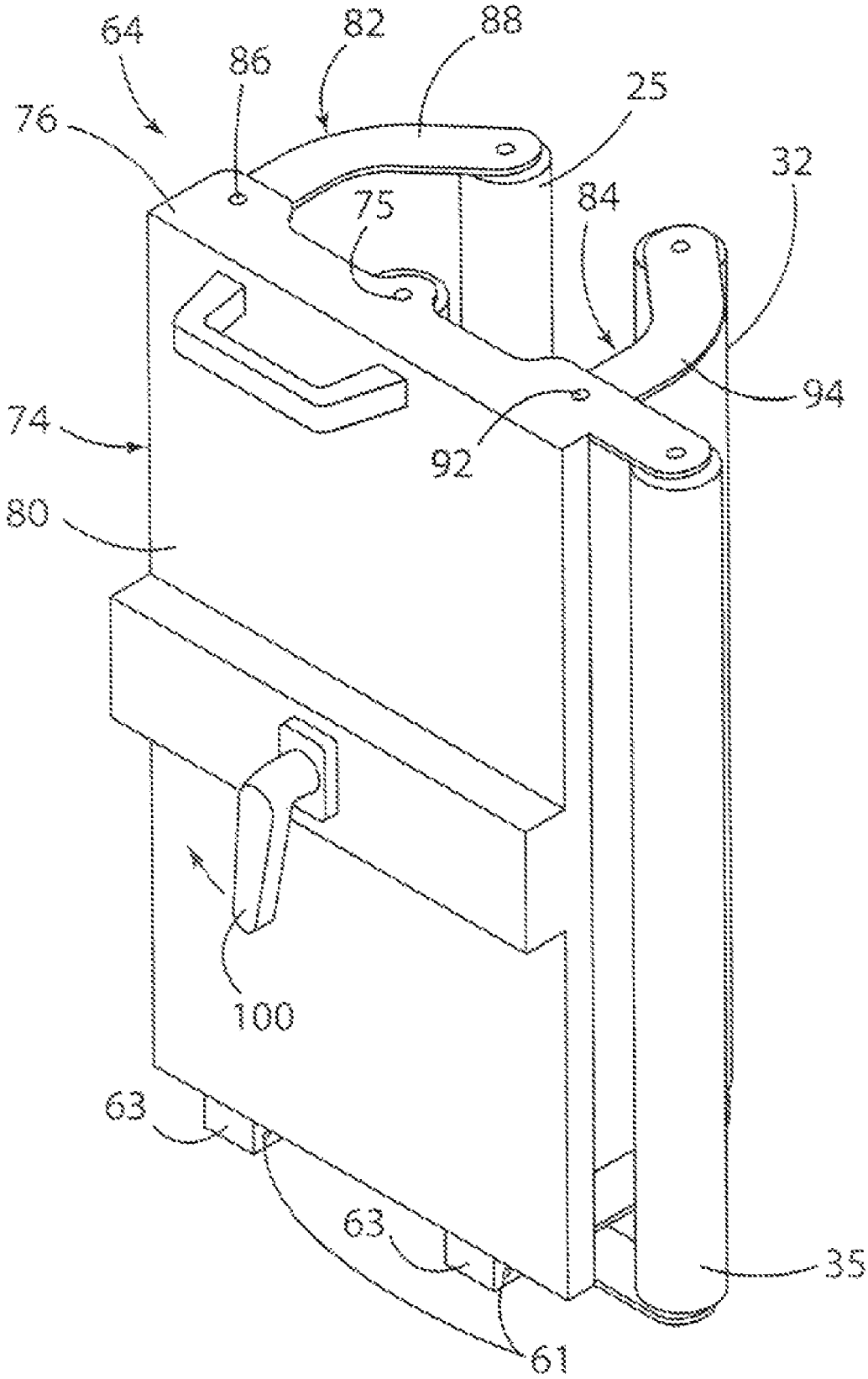
FIG. 8 is an isometric view of a chassis of the carriage of the present invention.
Figure 8A:
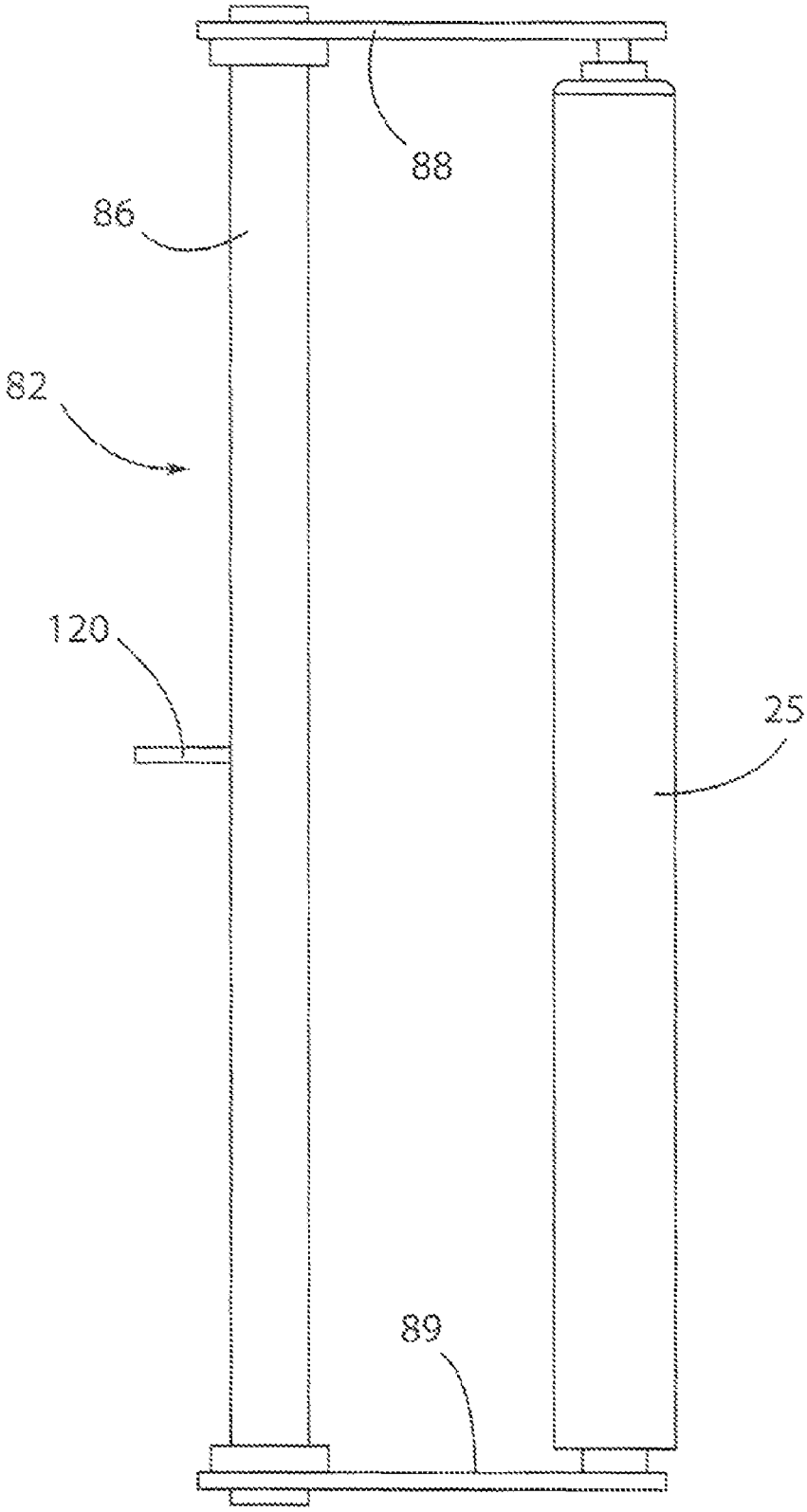
FIG. 8A is a side view of a nip roller assembly of the chassis of the carriage of the present invention.

FIG. 8A illustrates the first nip roller assembly 82, with the second nip roller assembly 84 being substantially similar to the first nip roller assembly 82 (except for possible dimension changes). In the illustrated example, the first nip roller assembly 82 comprises a first nip roller pivot axle 86 extending between the top portion 76 and the bottom portion 78 of the U-shaped door 74 at a first side thereof (adjacent the roll 22 of stretch wrap 20), a top nip roller pivot link 88 fixedly connected to a top of the first nip roller pivot axle 86 and a bottom nip roller pivot link 89 fixedly connected to a bottom of the first nip roller pivot axle 86. The first nip roller 25 is connected to the top nip roller pivot link 88 at a top thereof and to the bottom roller pivot link 89 at a bottom thereof. The first nip roller 25 is allowed to freely rotate relative to the top nip roller pivot link 88 and to the bottom roller pivot link 89. As discussed in more detail below, the first nip roller assembly 82 is configured to interact with a handle 100 to move the first nip roller 25 along the lines 36 and 56.

The illustrated second nip roller assembly 84 comprises a second nip roller pivot axle 92 extending between the top portion 76 and the bottom portion 78 of the U-shaped door 74 at a second side thereof (adjacent a diverter roller 35), a top nip roller pivot link 94 fixedly connected to a top of the second nip roller pivot axle 92 and a bottom nip roller pivot link 96 fixedly connected to a bottom of the second nip roller pivot axle 92. The second nip roller 32 is connected to the top nip roller pivot link 94 at a top thereof and to the bottom roller pivot link 96 at a bottom thereof. The second nip roller 32 is allowed to freely rotate relative to the top nip roller pivot link 94 and to the bottom roller pivot link 96. As discussed in more detail below, the second nip roller assembly 84 is configured to interact with the handle 100 to move the second nip roller 32 along the lines 38 and 58.

In the illustrated example, during use of the wrap machine 10 to wrap the package 24 with stretch wrap 20, the chassis 64 will be locked into position relative to the base housing 60 as illustrated in FIGS. 5-7 (and as shown schematically in FIG. 2). Furthermore, the first nip roller 25 will be locked into position abutting the first pre-stretch roller 26 and the second nip roller 32 will be locked into position abutting the second pre-stretch roller 30. Once the roll 22 of stretch wrap 20 is empty and the carriage 18 must be refilled with another roll 22 of stretch wrap 20, the chassis 64 must be moved to allow access to the stretch wrap 20 to be loaded (threaded) as discussed above in regard to FIG. 4. The first step in moving the chassis 64 to the loading position is to move the first nip roller 25 away from the first pre-stretch roller 26 along line 56 and to move the second nip roller 32 away from the second pre-stretch roller 30 along line 58.

Figure 9:
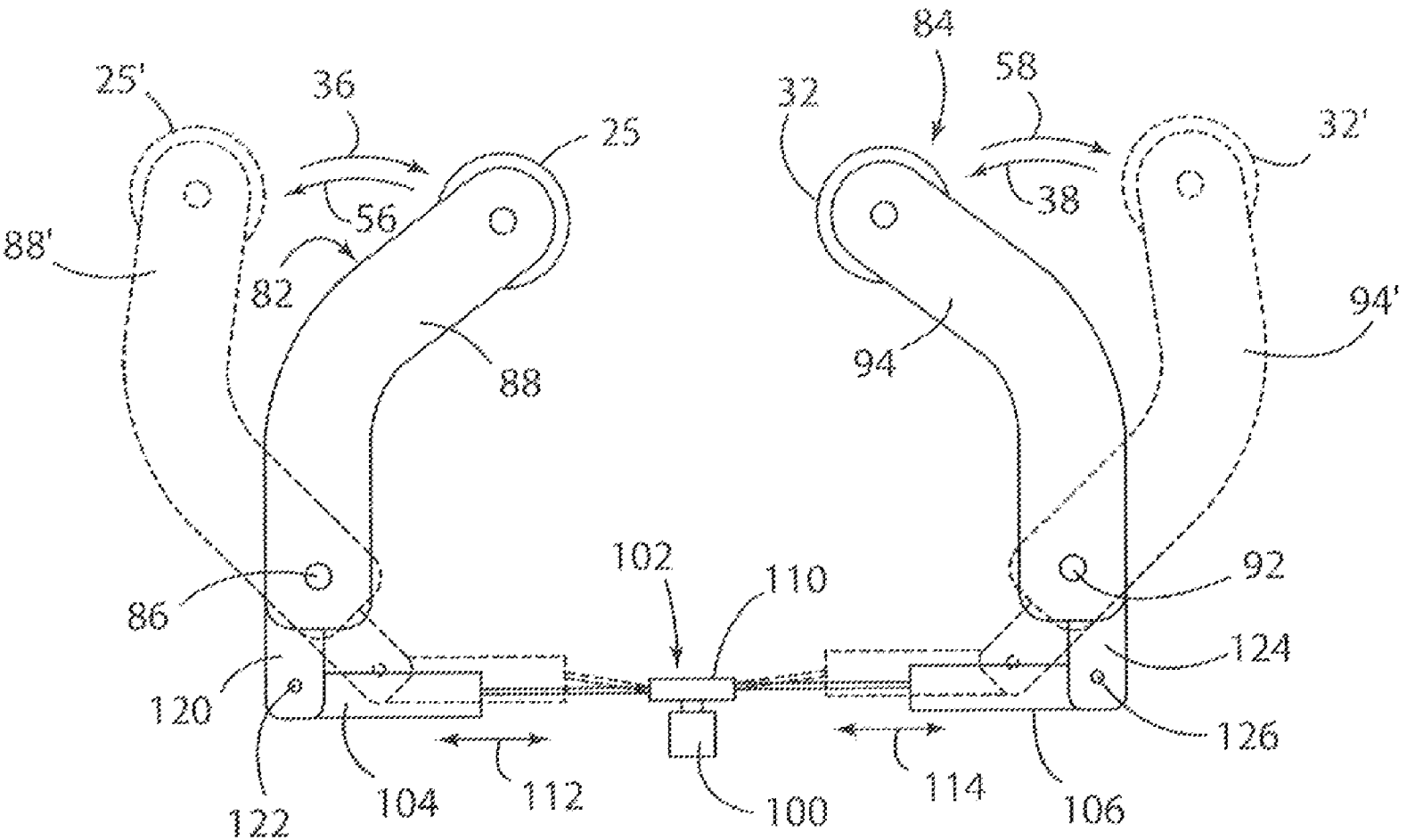
FIG. 9 is a top schematic view of a portion of the chassis of the carriage of the present invention showing movement of the nip roller assemblies of the chassis of the carriage of the present invention.
Figure 10:
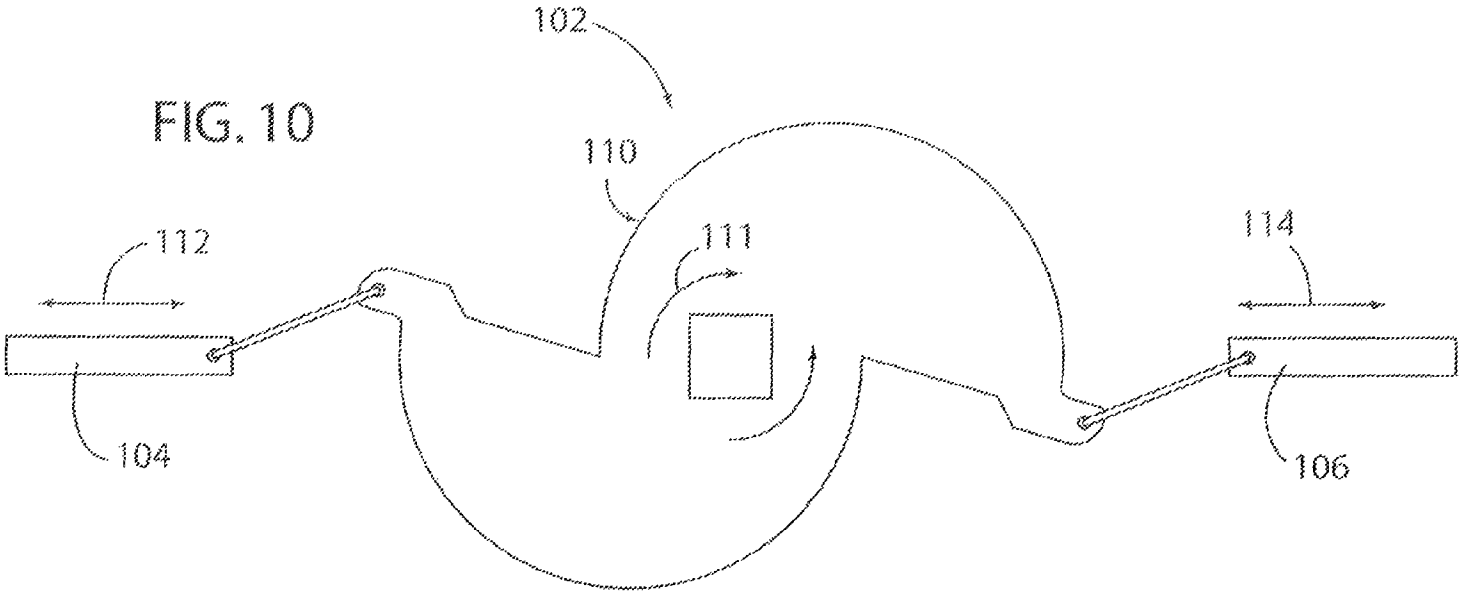
FIG. 10 is a front schematic view of a handle 100 and a linking assembly for moving the nip roller assemblies of the chassis of the carriage of the present invention.

The illustrated handle 100 (see FIGS. 5-8) is employed to move the first nip roller 25 away from the first pre-stretch roller 26 along line 56 and to move the second nip roller 32 away from the second pre-stretch roller 30 along line 58. The handle 100 is connected to a linking assembly 102 (see FIG. 9), which in turn is connected to the first nip roller assembly 82 and the second nip roller assembly 84. The linking assembly 102 includes a first link member 104 connected to the first nip roller pivot axle 86 and a second link member 106 connected to the second nip roller pivot axle 92. As illustrated in FIGS. 7 and 8, the handle 100 is pivotable about an axis that is perpendicular to a front face of the front face portion 80 of the U-shaped door 74. The handle 100 extends through the front face portion 80 of the U-shaped door 74 and includes a hub 110 connected to the first link member 104 and the second link member 106. The first link member 104 and the second link member 106 are configured to move linearly along lines 112 and 114 as shown in FIGS. 9 and 10. The first link member 104 is connected to the hub 110 above the center of rotation of the hub 110 and the second link member 106 is connected to the hub 110 below the center of rotation of the hub 110. Therefore, rotation of the handle 100 in the clockwise direction (as shown along line 111 in FIG. 10) will force the hub 110 to pull the first link member 104 to the right as shown in FIGS. 9 and 10 (i.e., towards the handle 100) and to pull the second link member 106 to the left as shown in FIGS. 9 and 10 (i.e., towards the handle 100).

As illustrated in FIG. 9, the first nip roller pivot axle 86 of the first nip roller assembly 82 includes a flange 120 extending therefrom. The flange 120 is pivotally connected to the first link member 104 at pivot point 122. Likewise, the second nip roller pivot axle 92 of the second nip roller assembly 84 includes a flange 124 extending therefrom. The flange 124 is pivotally connected to the second link member 106 at pivot point 126. As the first link member 104 is pulled towards the center during rotation of the handle 100 in the clockwise manner as discussed above, the flange 120 will be pulled to the right in FIGS. 9 and 10, thereby forcing the first nip roller pivot axle 86 to rotate in a counter-clockwise direction. Likewise, as the second link member 106 is pulled towards the center during rotation of the handle 100 in the clockwise manner as discussed above, the flange 124 will be pulled to the left in FIGS. 9 and 10, thereby forcing the second nip roller pivot axle 92 to rotate in a clockwise direction.

As illustrated in FIG. 9, as the first nip roller pivot axle 86 rotates in the counter-clockwise direction, the top nip roller pivot link 88 connected to a top of the first nip roller pivot axle 86 and the bottom nip roller pivot link 89 connected to a bottom the first nip roller pivot axle 86 will force the first nip roller 25 to move along line 56 (from 25 and 88 to 25' and 88' in FIG. 9 (i.e., in the configuration illustrated schematically in FIG. 3)). Likewise, as the second nip roller pivot axle 92 rotates in the clockwise direction, the top nip roller pivot link 94 connected to a top of the second nip roller pivot axle 92 and the bottom nip roller pivot link 96 connected to a bottom of the second nip roller pivot axle 92 will force the second nip roller 32 to move along line 58 (from 32 and 94 to 32' and 94' in FIG. 9 (i.e., in the configuration illustrated schematically in FIG. 3)).

Once the first nip roller 25 and the second nip roller 32 are moved outward as described above, the chassis 64 can be rotated about pivot point 69 along line 65 to allow the carriage to be loaded (threaded) as also described above in regard to FIG. 4. In order to position the chassis 64 back into position for wrapping the product 24, the chassis 64 is once again rotated about pivot point 69 along line 83 until the chassis 64 is positioned upright again. The handle 100 can then be rotated in a counter clockwise direction, thereby forcing the first nip roller 25 and the second nip roller 32 into contact with the first pre-stretch roller 26 and the second pre-stretch roller 30, respectively, in a manner opposite to that described above. It is contemplated that a top spring and/or a bottom spring can be connected to tops and bottoms of the first nip roller pivot axle 86 and the second nip roller pivot axle 92 to bias the first nip roller pivot axle 86 and the second nip roller pivot axle 92 to their base position (i.e., forcing the first nip roller 25 and the second nip roller 32 into contact with the first pre-stretch roller 26 and the second pre-stretch roller 30, respectively).

Figure 11:
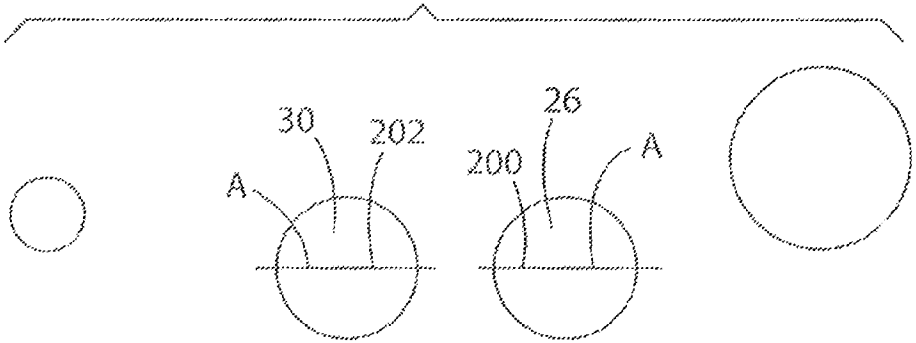
FIG. 11 is a schematic view of a portion of the carriage of the wrap machine of the present invention.

In the illustrated embodiment, it is noted that when the first nip roller 25 and the second nip roller 32 contact the first pre-stretch roller 26 and the second pre-stretch roller 30, respectively, the point of contact is beyond the front face of the circumference of the first pre-stretch roller 26 and the second pre-stretch roller 30 as viewed from FIG. 7 (i.e., on side A of lines 200 and 202 as illustrated in FIG. 11). Furthermore, once the first nip roller 25 and the second nip roller 32 are forced into contact with the first pre-stretch roller 26 and the second pre-stretch roller 30, respectively, the chassis 64 will not be able to be rotated (as the first pre-stretch roller 26 and the second pre-stretch roller 30 will prevent movement of the first nip roller 25 and the second nip roller 32 and thereby movement of the chassis 64). It is contemplated that the chassis 64 could be locked in position. For example, the handle 100 can be locked into position, thereby maintaining the position of the first nip roller 25 and the second nip roller 32 in contact with the first pre-stretch roller 26 and the second pre-stretch roller 30, respectively. It is contemplated that the handle 100 could include a lip on a terminal end thereof having an opening that is configured to be aligned with an opening on a latch flange such that an item (e.g., a padlock) can be placed through the aligned openings to lock the handle in position, thereby maintaining the position of the first nip roller 25 and the second nip roller 32 in contact with the first pre-stretch roller 26 and the second pre-stretch roller 30, respectively.

The above description is considered that of the one embodiment only. Modification of the invention will occur to those skilled in the art and to those who make or use the invention. For example, it is contemplated that the arms holding the nip rollers could be locked into place in some manner (e.g., a retractable pin) to lock the nip rollers in place and that the arms holding the nip rollers could be moved in any manner. It is further contemplated that the carriage 18 could include a pivoting arm 300 holding the dancer roller 34, with the arm 300 being biased by a spring 302 for keeping the dancer roller 34 taut against the stretch wrap 20 (see FIG. 7). Furthermore, it is contemplated that the carriage could be used in an overhead wrapping apparatus as is well known to those skilled in the art. Therefore, it is understood that the embodiment shown in the drawings and described above is merely for illustrative purposes and not intended to limit the scope of the invention.

We claim:

1. A stretch wrap assembly comprising:

a base;

a turntable mounted on the base;

a column extending upwardly from the base; and a carriage vertically movable upon the column, the carriage being configured to have stretch wrap thereon for wrapping a product on the turntable;

the carriage including a first nip roller, a first pre-stretch roller, a second pre-stretch roller and a second nip roller;

wherein the carriage is configured to have stretch wrap threaded through the carriage from a roll of stretch wrap, around a portion of a circumference of the first nip roller, around a portion of a circumference of the first pre-stretch roller, around a portion of a circumference of the second pre-stretch roller, around a portion of a circumference of the second nip roller and to the package;

wherein the first nip roller is configured to maintain the stretch wrap against the first pre-stretch roller as the stretch wrap is stretched by the first pre-stretch roller, and the second nip roller is configured to maintain the stretch wrap against the second pre-stretch roller as the stretch wrap is stretched by the second pre-stretch roller;

wherein the first nip roller and the second nip roller can move rotationally and laterally relative to the first pre-stretch roller and the second pre-stretch roller, respectively;

wherein a center of rotation of the first nip roller is located on a loaded side of a line drawn between a center of rotation of the first pre-stretch roller and a center of rotation of the second pre-stretch roller; and wherein a center of rotation of the second nip roller is also located on the loaded side of the line drawn between the center of rotation of the first pre-stretch roller and the center of rotation of the second pre-stretch roller.

2. The stretch wrap assembly of claim 1, wherein:

the first pre-stretch roller and the second pre-stretch roller are configured to be rotated at different speeds in order to stretch the stretch wrap as it passes by the first pre-stretch roller and the second pre-stretch roller.

3. The stretch wrap assembly of claim 1, wherein:

the carriage further includes a dancer roller, with the carriage being configured to have stretch wrap threaded around a portion of a circumference of the dancer roller and to the package.

4. The stretch wrap assembly of claim 1, wherein:

the first pre-stretch roller and the second pre-stretch roller have different circumferences in order to stretch the stretch wrap as it passes by the first pre-stretch roller and the second pre-stretch roller.

5. The stretch wrap assembly of claim 1, wherein:

the centers of rotation of the first and second nip rollers are on a loading side of the line between the centers of rotations of the first and second pre-stretch rollers during loading of the stretch wrap assembly;

the centers of rotation of the first and second nip rollers are on the loaded side of the line between the centers of rotations of the first and second pre-stretch rollers when the stretch wrap assembly is loaded; and the loading side and the loaded side are on opposite sides of the line between the centers of rotations of the first and second pre-stretch rollers.

6. A stretch wrap assembly comprising:

a base;

a turntable mounted on the base;

a column extending upwardly from the base; and a carriage vertically movable upon the column, the carriage being configured to have stretch wrap thereon for wrapping a product on the turntable;

the carriage including a first nip roller, a first pre-stretch roller, a second pre-stretch roller and a second nip roller;

wherein the carriage is configured to have stretch wrap threaded through the carriage from a roll of stretch wrap, around a portion of a circumference of the first nip roller, around a portion of a circumference of the first pre-stretch roller, around a portion of a circumference of the second pre-stretch roller, around a portion of a circumference of the second nip roller and to the package;

wherein the first nip roller is configured to maintain the stretch wrap against the first pre-stretch roller as the stretch wrap is stretched by the first pre-stretch roller, and the second nip roller is configured to maintain the stretch wrap against the second pre-stretch roller as the stretch wrap is stretched by the second pre-stretch roller;

wherein the first nip roller and the second nip roller can move rotationally and laterally relative to the first pre-stretch roller and the second pre-stretch roller, respectively;

wherein a center of rotation of the first nip roller is located on a side of a line drawn between a center of rotation of the first pre-stretch roller and a center of rotation of the second pre-stretch roller;

wherein a center of rotation of the second nip roller is also located on the side of the line drawn between the center of rotation of the first pre-stretch roller and the center of rotation of the second pre-stretch roller; and wherein the carriage comprises a housing having a base portion and a chassis movable relative to the base portion between an open position and a closed engaged position;

the base portion including the first pre-stretch roller and the second pre-stretch roller thereon; and the chassis having the first nip roller and the second nip roller thereon.

7. The stretch wrap assembly of claim 6, wherein:

the first nip roller and the second nip roller can move laterally relative to the first pre-stretch roller and the second pre-stretch roller, respectively, by moving the housing between the open position and the closed engaged position.

8. The stretch wrap assembly of claim 6, wherein:

the chassis further includes a dancer roller, with the carriage being configured to have stretch wrap threaded around a portion of a circumference of the dancer roller and to the package.

9. A carriage for a stretch wrap machine comprising:

a housing including a first nip roller, a first pre-stretch roller, a second pre-stretch roller and a second nip roller;

wherein the carriage is configured to have stretch wrap threaded through the carriage from a roll of stretch wrap, around a portion of a circumference of the first nip roller, around a portion of a circumference of the first pre-stretch roller, around a portion of a circumference of the second pre-stretch roller, around a portion of a circumference of the second nip roller and to the package;

wherein the first nip roller is configured to maintain the stretch wrap against the first pre-stretch roller as the stretch wrap is stretched by the first pre-stretch roller, and the second nip roller is configured to maintain the stretch wrap against the second pre-stretch roller as the stretch wrap is stretched by the second pre-stretch roller; and wherein the first nip roller and the second nip roller can move rotationally and laterally relative to the first pre-stretch roller and the second pre-stretch roller, respectively;

wherein a center of rotation of first nip roller is located on a loaded side of a line drawn between a center of rotation of the first pre-stretch roller and a center of rotation of the second pre-stretch roller; and wherein a center of rotation of second nip roller is also located on the loaded side of the line drawn between the center of rotation of the first pre-stretch roller and the center of rotation of the second pre-stretch roller.

10. The carriage of claim 9, wherein:

the first pre-stretch roller and the second pre-stretch roller are configured to be rotated at different speeds in order to stretch the stretch wrap as it passes by the first pre-stretch roller and the second pre-stretch roller.

11. The carriage of claim 9, wherein:

the carriage further includes a dancer roller, with the carriage being configured to have stretch wrap threaded around a portion of a circumference of the dancer roller and to the package.

12. The carriage of claim 9, wherein:

the first pre-stretch roller and the second pre-stretch roller have different circumferences in order to stretch the stretch wrap as it passes by the first pre-stretch roller and the second pre-stretch roller.

13. The carriage of claim 9, wherein:

the centers of rotation of the first and second nip rollers are on a loading side of the line between the centers of rotations of the first and second pre-stretch rollers during loading of the carriage;

the centers of rotation of the first and second nip rollers are on the loaded side of the line between the centers of rotations of the first and second pre-stretch rollers when the carriage is loaded; and the loading side and the loaded side are on opposite sides of the line between the centers of rotations of the first and second pre-stretch rollers.

14. A carriage for a stretch wrap machine comprising:

a housing including a first nip roller, a first pre-stretch roller, a second pre-stretch roller and a second nip roller;

wherein the carriage is configured to have stretch wrap threaded through the carriage from a roll of stretch wrap, around a portion of a circumference of the first nip roller, around a portion of a circumference of the first pre-stretch roller, around a portion of a circumference of the second pre-stretch roller, around a portion of a circumference of the second nip roller and to the package;

wherein the first nip roller is configured to maintain the stretch wrap against the first pre-stretch roller as the stretch wrap is stretched by the first pre-stretch roller, and the second nip roller is configured to maintain the stretch wrap against the second pre-stretch roller as the stretch wrap is stretched by the second pre-stretch roller;

wherein the first nip roller and the second nip roller can move rotationally and laterally relative to the first pre-stretch roller and the second pre-stretch roller, respectively;

wherein a center of rotation of first nip roller is located on a side of a line drawn between a center of rotation of the first pre-stretch roller and a center of rotation of the second pre-stretch roller;

wherein a center of rotation of second nip roller is also located on the side of the line drawn between the center of rotation of the first pre-stretch roller and the center of rotation of the second pre-stretch roller;

wherein the housing has a base portion and a chassis movable relative to the base portion between an open position and a closed engaged position;

wherein the base portion includes the first pre-stretch roller and the second pre-stretch roller thereon; and wherein the chassis has the first nip roller and the second nip roller thereon.

15. The carriage of claim 14, wherein:

the first nip roller and the second nip roller can move laterally relative to the first pre-stretch roller and the second pre-stretch roller, respectively, by moving the housing between the open position and the closed engaged position.

16. The carriage of claim 14, wherein:

the chassis further includes a dancer roller, with the carriage being configured to have stretch wrap threaded around a portion of a circumference of the dancer roller and to the package.

17. A carriage for a stretch wrap machine comprising:

a housing having a base portion and a chassis movable relative to the base portion between an open position and a closed engaged position;

the base portion including a first pre-stretch roller and a second pre-stretch roller thereon;

the chassis having a first nip roller and a second nip roller thereon;

wherein the housing, when in the closed engaged position, is configured to have stretch wrap threaded through the carriage from a roll of stretch wrap, around a portion of a circumference of the first nip roller, around a portion of a circumference of the first pre-stretch roller, around a portion of a circumference of the second pre-stretch roller, around a portion of a circumference of the second nip roller and to the package;

wherein, when the housing is in the closed engaged position, the first nip roller is configured to maintain the stretch wrap against the first pre-stretch roller as the stretch wrap is stretched by the first pre-stretch roller, and the second nip roller is configured to maintain the stretch wrap against the second pre-stretch roller as the stretch wrap is stretched by the second pre-stretch roller; and wherein the first nip roller and the second nip roller can move laterally relative to the first pre-stretch roller and the second pre-stretch roller, respectively, by moving the housing between the open position and the closed engaged position.

18. The carriage of claim 17, wherein:

the first pre-stretch roller and the second pre-stretch roller are configured to be rotated at different speeds in order to stretch the stretch wrap as it passes by the first pre-stretch roller and the second pre-stretch roller.

19. The carriage of claim 17, wherein:

the chassis further includes a dancer roller, with the carriage being configured to have stretch wrap threaded around a portion of a circumference of the dancer roller and to the package.

20. The carriage of claim 17, wherein:

the chassis further includes an idler roller;

the housing, when in the closed engaged position, is configured to have stretch wrap around a portion of a circumference of the idler roller;

when the housing is in the closed engaged position, the idler roller rotates freely and is positioned to maintain the stretch wrap against the first pre-stretch roller and the second pre-stretch roller;

the idler roller is spaced from the first pre-stretch roller such that the idler roller and the first pre-stretch roller do not touch when the housing is in the engaged position; and the idler roller is spaced from the second pre-stretch roller such that the idler roller and the second pre-stretch roller do not touch when the housing is in the engaged position.

21. The carriage of claim 20, wherein:

in the open position, the idler roller is not directly located between the first pre-stretch roller and the second pre-stretch roller;

in the closed engaged position, the idler roller is directly located between the first pre-stretch roller and the second pre-stretch roller;

the idler roller moves along a first plane as the housing moves from the open position to the closed engaged position;

the first nip roller and the second nip roller firstly move along a second plane and a third plane, respectively, as the housing moves from the open position to the closed engaged position and then secondly moves along a first arc and a second arc as the housing moves from the open position to the closed engaged position; and the first plane, the second plane and the third plane are parallel.

22. The carriage of claim 21, wherein:

the chassis further includes a dancer roller, with the carriage being configured to have stretch wrap threaded around a portion of a circumference of the dancer roller and to the package.

23. The carriage of claim 17, wherein:

the first pre-stretch roller and the second pre-stretch roller have different circumferences in order to stretch the stretch wrap as it passes by the first pre-stretch roller and the second pre-stretch roller.

24. A carriage for a stretch wrap machine comprising:

a housing having a base portion and a chassis movable relative to the base portion between an open position and a closed engaged position;

the base portion including a first pre-stretch roller and a second pre-stretch roller thereon;

the chassis having a first nip roller and a second nip roller thereon;

wherein the housing, when in the closed engaged position, is configured to have stretch wrap threaded through the carriage from a roll of stretch wrap, around a portion of a circumference of the first nip roller, around a portion of a circumference of the first pre-stretch roller, around a portion of a circumference of the second pre-stretch roller, around a portion of a circumference of the second nip roller and to the package;

wherein, when the housing is in the closed engaged position, the first nip roller is configured to maintain the stretch wrap against the first pre-stretch roller as the stretch wrap is stretched by the first pre-stretch roller, and the second nip roller is configured to maintain the stretch wrap against the second pre-stretch roller as the stretch wrap is stretched by the second pre-stretch roller; and wherein the first nip roller and the second nip roller firstly move along a first plane and a second plane, respectively, as the housing moves from the open position to the closed engaged position and then secondly moves along a first arc and a second arc as the housing moves from the open position to the closed engaged position;

wherein the first plane and the second plane are parallel.

25. The carriage of claim 24, wherein:

the first pre-stretch roller and the second pre-stretch roller are configured to be rotated at different speeds in order to stretch the stretch wrap as it passes by the first pre-stretch roller and the second pre-stretch roller.

26. The carriage of claim 24, wherein:

the chassis further includes an idler roller;

the housing, when in the closed engaged position, is configured to have stretch wrap around a portion of a circumference of the idler roller;

when the housing is in the closed engaged position, the idler roller rotates freely and is positioned to maintain the stretch wrap against the first pre-stretch roller and the second pre-stretch roller;

in the open position, the idler roller is not directly located between the first pre-stretch roller and the second pre-stretch roller;

in the closed engaged position, the idler roller is directly located between the first pre-stretch roller and the second pre-stretch roller;

the idler roller moves along a third plane as the housing moves from the open position to the closed engaged position; and the first plane, the second plane and the third plane are parallel.

27. The carriage of claim 26, wherein:

the idler roller is spaced from the first pre-stretch roller.

28. The carriage of claim 27, wherein:

the idler roller is spaced from the second pre-stretch roller.

29. The carriage of claim 26, wherein:

the idler roller is spaced from the second pre-stretch roller.

30. The carriage of claim 24, wherein:

the first pre-stretch roller and the second pre-stretch roller have different circumferences in order to stretch the stretch wrap as it passes by the first pre-stretch roller and the second pre-stretch roller.

31. A stretch wrap assembly comprising:

a base;

a turntable mounted on the base;

a column extending upwardly from the base; and a carriage vertically movable upon the column, the carriage being configured to have stretch wrap thereon for wrapping a product on the turntable;

the carriage including a first nip roller, a first pre-stretch roller, a second pre-stretch roller and a second nip roller;

wherein the carriage is configured to have stretch wrap threaded through the carriage from a roll of stretch wrap, around a portion of a circumference of the first nip roller, around a portion of a circumference of the first pre-stretch roller, around a portion of a circumference of the second pre-stretch roller, around a portion of a circumference of the second nip roller and to the package;

wherein the first nip roller is configured to maintain the stretch wrap against the first pre-stretch roller as the stretch wrap is stretched by the first pre-stretch roller, and the second nip roller is configured to maintain the stretch wrap against the second pre-stretch roller as the stretch wrap is stretched by the second pre-stretch roller;

wherein the first nip roller and the second nip roller can move rotationally and laterally relative to the first pre-stretch roller and the second pre-stretch roller, respectively;

wherein a center of rotation of the first nip roller is located on a side of a line drawn between a center of rotation of the first pre-stretch roller and a center of rotation of the second pre-stretch roller; and wherein a center of rotation of the second nip roller is also located on the side of the line drawn between the center of rotation of the first pre-stretch roller and the center of rotation of the second pre-stretch roller;

the carriage further includes an idler roller;

the carriage is configured to further have stretch wrap threaded around a portion of a circumference of the idler roller;

the idler roller rotates freely and is positioned to maintain the stretch wrap against the first pre-stretch roller and the second pre-stretch roller;

the idler roller is spaced from the first pre-stretch roller such that the idler roller and the first pre-stretch roller do not touch;

the idler roller is spaced from the second pre-stretch roller such that the idler roller and the second pre-stretch roller do not touch; and a center of rotation of the idler roller is located on a first side of a line drawn between a center of rotation of the first pre-stretch roller and a center of rotation of the second pre-stretch roller.

32. The stretch wrap assembly of claim 31, wherein:

the carriage comprises a housing having a base portion and a chassis movable relative to the base portion between an open position and a closed engaged position;

the base portion includes the first pre-stretch roller and the second pre-stretch roller thereon; and the chassis has the first nip roller, the idler roller and the second nip roller thereon.

33. The stretch wrap assembly of claim 32, wherein:

in the open position, the idler roller is not directly located between the first pre-stretch roller and the second pre-stretch roller;

in the closed engaged position, the idler roller is directly located between the first pre-stretch roller and the second pre-stretch roller;

the idler roller moves along a first plane as the housing moves from the open position to the closed engaged position;

the first nip roller and the second nip roller firstly move along a second plane and a third plane, respectively, as the housing moves from the open position to the closed engaged position and then secondly moves along a first arc and a second arc as the housing moves from the open position to the closed engaged position; and the first plane, the second plane and the third plane are parallel.

34. A carriage for a stretch wrap machine comprising:

a housing including a first nip roller, a first pre-stretch roller, a second pre-stretch roller and a second nip roller;

wherein the carriage is configured to have stretch wrap threaded through the carriage from a roll of stretch wrap, around a portion of a circumference of the first nip roller, around a portion of a circumference of the first pre-stretch roller, around a portion of a circumference of the second pre-stretch roller, around a portion of a circumference of the second nip roller and to the package;

wherein the first nip roller is configured to maintain the stretch wrap against the first pre-stretch roller as the stretch wrap is stretched by the first pre-stretch roller, and the second nip roller is configured to maintain the stretch wrap against the second pre-stretch roller as the stretch wrap is stretched by the second pre-stretch roller; and wherein the first nip roller and the second nip roller can move rotationally and laterally relative to the first pre-stretch roller and the second pre-stretch roller, respectively;

wherein a center of rotation of first nip roller is located on a side of a line drawn between a center of rotation of the first pre-stretch roller and a center of rotation of the second pre-stretch roller; and wherein a center of rotation of second nip roller is also located on the side of the line drawn between the center of rotation of the first pre-stretch roller and the center of rotation of the second pre-stretch roller;

the housing further includes an idler roller;

the carriage is configured to have stretch wrap around a portion of a circumference of the idler roller;

the idler roller rotates freely and is positioned to maintain the stretch wrap against the first pre-stretch roller and the second pre-stretch roller;

the idler roller is spaced from the first pre-stretch roller such that the idler roller and the first pre-stretch roller do not touch;

the idler roller is spaced from the second pre-stretch roller such that the idler roller and the second pre-stretch roller do not touch; and a center of rotation of the idler roller is located on a first side of a line drawn between a center of rotation of the first pre-stretch roller and a center of rotation of the second pre-stretch roller.

35. The carriage of claim 34, wherein:

in the open position, the idler roller is not directly located between the first pre-stretch roller and the second pre-stretch roller;

in the closed engaged position, the idler roller is directly located between the first pre-stretch roller and the second pre-stretch roller;

the idler roller moves along a first plane as the housing moves from the open position to the closed engaged position;

the first nip roller and the second nip roller firstly move along a second plane and a third plane, respectively, as the housing moves from the open position to the closed engaged position and then secondly moves along a first arc and a second arc as the housing moves from the open position to the closed engaged position; and the first plane, the second plane and the third plane are parallel.

36. The carriage of claim 34, wherein:

the housing has a base portion and a chassis movable relative to the base portion between an open position and a closed engaged position;

the base portion includes the first pre-stretch roller and the second pre-stretch roller thereon; and the chassis has the first nip roller, the idler roller and the second nip roller thereon.

* * * * *